United States Patent [19]

Roberts

[11] 4,067,092

[45] Jan. 10, 1978

[54] COMPRESSION CRIMPING APPARATUS

[76] Inventor: John S. Roberts, 3450 Tyler Court, Ellicott, Md. 21043

[21] Appl. No.: 696,699

[22] Filed: June 16, 1976

[51] Int. Cl.[2] ..... D02G 1/12

[52] U.S. Cl. ..... 28/251; 28/264

[58] Field of Search ..... 28/1.6, 1.7, 250, 251, 28/264; 26/21

[56] References Cited

U.S. PATENT DOCUMENTS

| | | | |
|---|---|---|---|
| 36,005 | 7/1862 | Hunt et al. | 26/21 |
| 87,806 | 3/1869 | Waite | 26/21 |
| 2,960,730 | 11/1960 | Shattuck | 28/1.7 |
| 3,110,076 | 11/1963 | Trifunovic et al. | 28/1.6 |
| 3,174,206 | 3/1965 | Mattingly et al. | 28/1.7 |
| 3,200,466 | 8/1965 | Duga et al. | 28/1.7 |
| 3,241,213 | 3/1966 | Thompson, Jr. et al. | 28/1.6 |
| 3,345,719 | 10/1967 | Schatz et al. | 28/1.7 |
| 3,388,440 | 6/1968 | Stanley | 28/1.7 |
| 3,413,696 | 12/1968 | Flowers et al. | 28/1.7 |
| 3,460,214 | 8/1969 | Hodges | 28/1.7 |
| 3,587,145 | 6/1971 | McKinney et al. | 28/1.7 |
| 3,594,879 | 7/1971 | Zeis et al. | 28/1.7 |
| 3,636,149 | 1/1972 | Tambini | 28/1.7 X |
| 3,688,356 | 9/1972 | Scowcroft et al. | 28/1.7 |
| 3,961,401 | 6/1976 | Ferrier | 28/1.6 X |

FOREIGN PATENT DOCUMENTS

| | | | |
|---|---|---|---|
| 6,610,253 | 8/1967 | Netherlands | 28/264 |
| 1,379,041 | 1/1975 | United Kingdom | 28/251 |
| 1,415,655 | 11/1975 | United Kingdom | 28/264 |

*Primary Examiner*—Robert R. Mackey
*Attorney, Agent, or Firm*—Nolte and Nolte

[57] ABSTRACT

Apparatus for compression crimping is provided comprising means defining a compression crimping zone, means for feeding fibrous material into and means for withdrawing crimped fibrous material from the compression crimping zone, at least one movable member defining a lateral wall of the zone and being biased toward the fibrous material to restrict egress of the fibrous material from the zone and thereby exert a back pressure on the fibrous material, causing the fibrous material to buckle and thereby crimp in the zone, control means for acting on at least one of the fibrous material feeding means and fibrous material withdrawing means, preferably for deactuating both, in response to displacement beyond a predetermined extent of the movable member in a direction opposite to the direction in which the movable member is biased, and means for sensing the presence of the plug at a predetermined position in the zone and for regulating at least one of the fibrous material feeding means and fibrous material withdrawal means in response to said sensing.

5 Claims, 3 Drawing Figures

12'
62
60
60'
61'
61
68
69
10
11
59
53
63'
65
64
63
19
20
30
27
29
32
33
31
34
21
22
17
18
13
15
16
14
12

COMPRESSION CRIMPING APPARATUS

BACKGROUND OF THE INVENTION

This invention relates to apparatus for compression crimping fibrous material. More particularly, this invention relates to improvements involving control of the apparatus in response to the position in the crimping zone of the apparatus of the plug of crimped fibrous material which is formed in the crimping zone.

Various apparatus for compression crimping fibrous material are known which comprise means defining a compression crimping zone, means for feeding fibrous material into the compression crimping zone and at least one movable member defining a lateral wall of the zone and being biased toward the fibrous material to restrict egress of the fibrous material from the zone and thereby exert a back pressure on the fibrous material, causing the fibrous material to buckle and thereby crimp in the zone. More particularly, the movable member may be a pressure shoe. A pair of such shoes, which are arranged opposite each other and are biased toward each other, may be employed. The apparatus must be controlled so that the plug itself remains in the crimping zone and the crimped fibrous material is withdrawn from the plug while the plug remains in the crimping zone.

To this end, the apparatus frequently includes means for sensing advance of the plug to a predetermined position in the crimping zone which position represents the forwardmost point that the leading end of the plug is to be permitted to reach. When the leading end of the plug is sensed at this position, means are actuated for increasing the rate of withdrawal of crimped fibrous material from the zone and/or decreasing the rate of feeding of fibrous material to the zone. This is continued until the leading end of the plug has withdrawn from said predetermined position. It is readily understood that this requires that the apparatus be operated with a slight overfeed tendency since no sensing device is provided to detect displacement of the leading end in the direction counter to the net direction of travel of the yarn through the crimping zone. Alternatively, a second sensing device at a position in the crimping zone spaced upstream from the first sensing device may be provided, the first sensing device operating as described above and impingement of the leading end of the plug upon the second sensing device causing a decrease in the rate of withdrawal of the yarn from the zone and/or increase in the rate of feed of yarn to the zone and this decrease or increase not being interrupted until the leading end of the plug retreats to a point immediately downstream from the second sensing device. In this case, the apparatus is operated with neither an underfeed nor an overfeed tendency. Yet another alternative, this necessitating operation with a slight underfeed tendency, is to arrange a single sensing device for actuating an increase in the rate of feed of the yarn to the zone and/or a decrease in the rate of withdrawal of the yarn from the zone only when the leading end of the plug retreats so that it is downsteam of the sensing device. In all of these cases, the position of the leading end of the plug is being maintained substantially constant or substantially within a relatively small range so that the yarn is being subjected to substantially constant compression crimping conditions thereby to obtain a substantially uniform product.

Apart from mechanical feelers, which have the disadvantage of contacting the plug and, consequently, perhaps affecting the crimping, a source of visible light and a photoelectric cell have been used as a sensing device for the plug. However, these devices are somewhat non-uniform in their response to the leading end of the plug because they use visible light. For example, the leading end of the plug may have to impinge upon the light directed at the photoelectric cell to different extents depending upon the color of the yarn to cause the same response by the photoelectric cell.

Another problem in the prior art is that a sensing device for the plug, whether mechanically or photoelectrically actuated, may wear out or fail. If no auxiliary sensing device is provided, the plug may then be displaced out of the crimping zone, resulting in lack of adequate control of the crimping and possible fouling of the equipment outside the crimping zone.

It is an object of the invention to provide improved means for sensing the plug, which improved means are free of the aforementioned disadvantages.

It is a further object of the present invention to provide a device to shut down equipment in the event of failure of the plug sensing device, particularly for a compression crimping apparatus employing at least one movable member defining a lateral wall of the compression crimping zone.

Other objects and advantages of the invention will be apparent to one skilled in the art from the following description of the invention.

SUMMARY OF THE INVENTION

According to one aspect of the present invention, there is provided apparatus for compression crimping fibrous material comprising means defining a compression crimping zone in which a plug of compression crimped fibrous material is formed, means for feeding fibrous material into the compression crimping zone, means for withdrawing compression crimped fibrous material from the compression crimping zone and means for sensing the presence of the plug at a predetermined position in the zone and for regulating at least one of the fibrous material feeding means and fibrous material withdrawal means in response to said sensing thereby to prevent said plug from moving substantially beyond said position, the sensing means comprising a light-emitting diode and a sensor for the light emitted by the diode, the diode and the sensor being arranged on opposite sides of the zone with a path being defined for passage of the light from the diode to the sensor on a line which intersects the compression crimping zone at the aforementioned predetermined position.

Light-emitting diodes and sensors therefor, the latter of which are functionally analogous to photoelectric cells, are well known in themselves. However, the present invention represents a novel, unobvious application thereof. Light emitted by a light-emitting diode employed in the present invention is invisible, being of a shorter wave length than can be detected by the human eye. Light of such wave length is not affected by the color of the yarn.

According to another aspect of the present invention, means are provided for detecting imminent overflow of the plug of crimped yarn from the crimping zone. While this means may be used in combination with the aforementioned sensing means employing light-emitting diodes, it will be apparent that it has utility in and of itself and can be used with other sensing means. Since this sensing means would commonly be used as a back-up to shut down the machine in the event of failure of the primary sensing means, it will hereinafter somtimes be referred to as "auxiliary sensing means." It is to be understood, however, that this terminology is not intended as a limitation that this sensing means be used in combination with other sensing means.

The auxiliary sensing means of the present invention is for use in a compression crimping apparatus of the type in which at least one movable member defines a lateral wall of a compression crimping zone and is biased toward the fibrous material which is being crimped to restrict egress of the fibrous material from the zone and thereby exert a back pressure on the fibrous material, causing the fibrous material to buckle and thereby crimp in the zone. More particularly, the apparatus is of the type comprising means defining a compression crimping zone and means for feeding fibrous material into the compression crimping zone, as well as means for withdrawing the resultant crimped fibrous material from the crimping zone, in which at least one movable member defines a lateral wall of the zone and acts in the manner described above. In a preferred embodiment of an improvement according to the invention, the auxiliary sensing means detects excessive displacement of the movable member, which is indicative of overloading of the crimping zone, and in response thereto deactuates the respective means for feeding yarn to and withdrawing yarn from the crimping zone. In this embodiment, the device functions to shut down the crimping machine if a malfunction of the primary sensing device or other malfunction has permitted the crimping zone to overload. Alternatively, the sensed excessive displacement of the movable member can be employed to actuate a slowing of the means for feeding the fibrous material to the crimping zone and/or an increase in the speed of the means for withdrawing the crimped fibrous material from the crimping zone until the leading end of the plug of crimped fibrous material retreats sufficiently so that the movable member returns to a normal operating position. In such a case, in which sensing of excessive displacement of the movable member would be used for primary control of the position of the leading end of the plug, the sensing means would be arranged to actuate speed up of the rate of withdrawal of the yarn from the zone or slow down of the rate of feed of the yarn to the zone in response to lesser, only slightly excessive, displacements of the movable member, thereby to maintain substantially uniform crimping. In the preferred embodiment of the present invention, it is contemplated, however, that the means for detecting excessive displacement of the movable member be utilized in the aforementioned back-up capacity.

Frequently, movable members of the aforementioned type are used in pairs, with the movable members being arranged opposite each other and being biased toward each and with the plug being confined therebetween. In such an apparatus, a respective means for sensing excessive displacement of a movable member may be associated with each of the movable members, whereby excessive displacement of either of the members will deactuate the fibrous feeding and withdrawing means or slow down the fibrous material feeding means and/or speed up the fibrous material withdrawing means.

DESCRIPTION OF A PREFERRED EMBODIMENT

The invention will now be further described by reference to a preferred embodiment, as illustrated in the drawings, in which.

Figure 1:
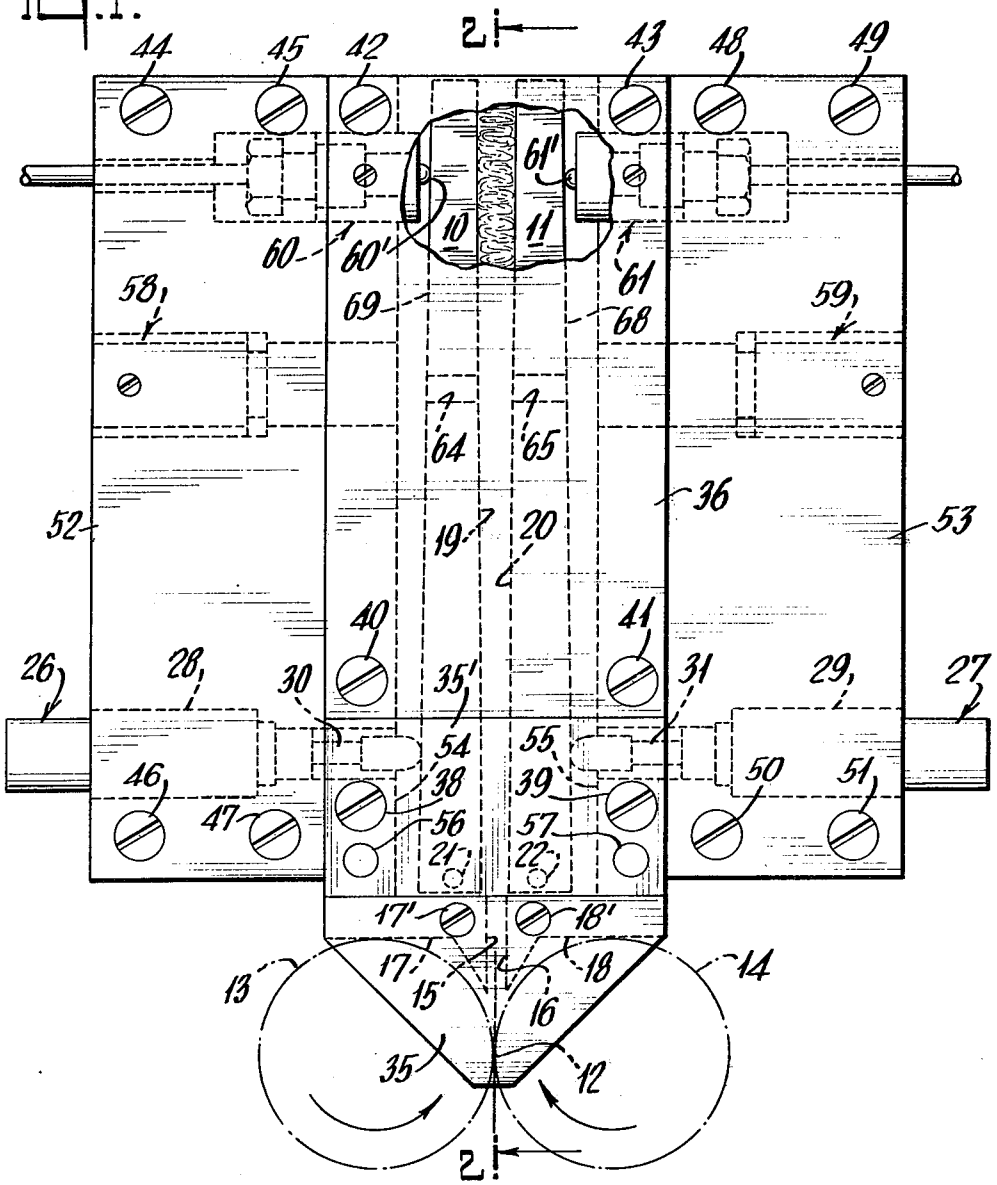
FIG. 1 is a front elevation, partly broken away, of a compression crimping head embodying the improvements of the present invention.
Figure 3:
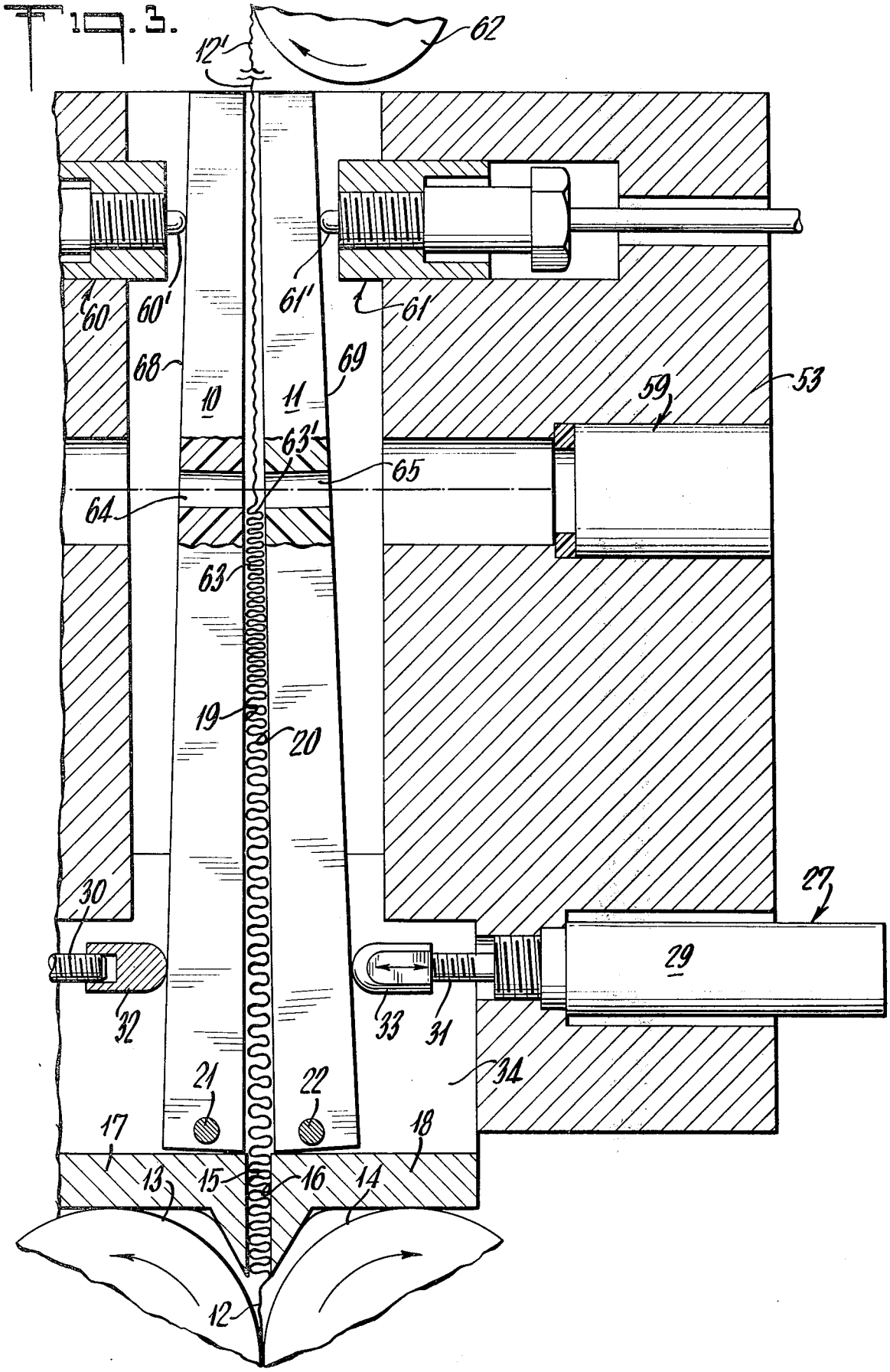
FIG. 3 is a sectional front elevation of the apparatus of FIGS. 1 and 2.

The portion of a crimping apparatus including the crimping zone is commonly referred to as a crimping head or a crimper head. In FIG. 1, a compression crimping head is illustrated in which members, more particularly pressure shoes, 10 and 11 define lateral walls of the zone. An uncrimped yarn 12 is fed into the crimping head by means of counter rotating driven nip rollers 13 and 14, the directions of rotation of which are indicated by respective arrows in FIG. 1. The crimping zone has static lateral walls defined by mutually opposed faces 15, 16 of respective side rails 17, 18 followed by dynamic lateral walls defined by opposed faces 19, 20 of pressure shoes 10, 11 (FIG. 1 and 3).

Figure 2:
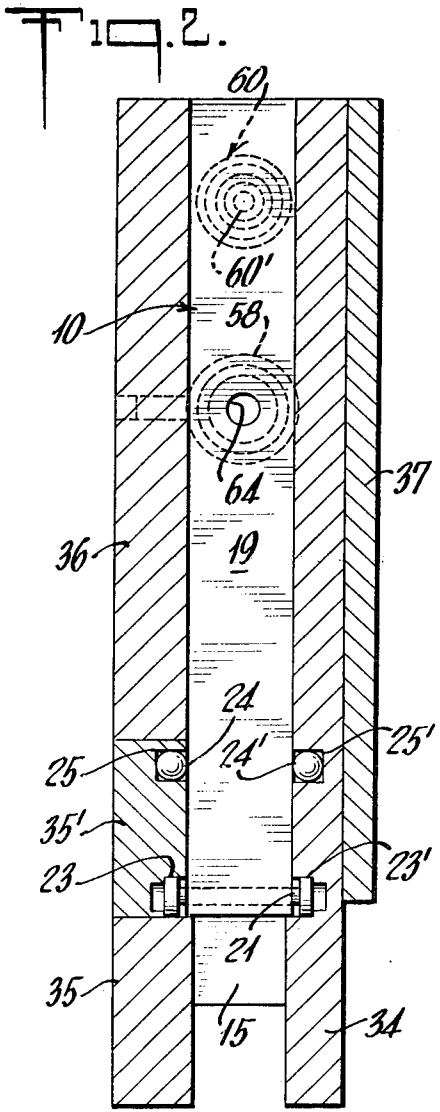
FIG. 2 is a section taken along line 2-2 of FIG. 1.

The faces 19 and 20 define dynamic walls of the compression crimping zone because the pressure shoes 10, 11 are mounted on respective pivot shafts 21, 22 which are supported in pairs of bearings 23, 23', (FIG. 2). The pivotal movement of the shoes 10, 11 is assisted by ball bearings 24, 24' which are arranged in recesses 25, 25' (FIG. 2).

The shoes 10, 11 are biased toward each other by respective pneumatic cylinder and piston assemblies 26, 27. The assemblies 26, 27 have respective cylinders 28, 29 and respective pistons 30, 31. The pistons 30, 31 are provided with respective end caps 32, 33, which bear against respective shoes 10, 11.

The rails 17 and 18 are held by screws 17', 18' between the crimper head base plate 34 and the crimper head lower cover 35. The bearings 23, 23' for the bearing shaft 21 are mounted in respective recesses in the upper cover 35' and the base plate 34. The bearings for the other bearing shaft, which are not illustrated, are mounted in the same way. The base plate 34 extends the rest of the way up to the top of the pressure shoes 10, 11, and on the other side of the pressure shoes, a front plate 36 extends up to the top of the pressure shoes. The upper cover 35' is held in place by screws 38 and 39 as well as dowels 56 and 57 and the plate 36 is held in place by screws 40 to 43, inclusive. Mounted on a sub-base plate 37 adjacent respective shoes 10 and 11, by means of screws 44 to 51, inclusive, are blocks 52 and 53. Finally, adjacent the lower ends of the shoes 10 and 11 are respective spacers 54 and 55 which are held in place by screws 38 and 39 as well as dowels 56 and 57.

The foregoing is all, of course, suitably supported on a machine.

The blocks 52 and 53 not only support the pneumatic cylinder and piston assemblies 26 and 27 but also support a light-emitting diode assembly 58, a sensor 59 for the light emitted from the diode, and limit switch assemblies 60 and 61.

An uncrimped yarn 12 is advanced between the rails 17 and 18 by means of the nip rollers 13 and 14. FIG. 3 illustrates the operation of the machine under normal conditions whereas FIG. 1 illustrates the operation of the machine when there has been a malfunction whereby the leading end of the plug of yarn has moved substantially past the light path of the light-emitting diode 58. With reference to FIG. 3, it is seen that the relative linear rates at which the crimped yarn 12' is taken up by the driven take-up package 62 and at which the uncrimped yarn 12 is fed into the head by the nip rollers 13 and 14 are maintained so that the leading end 63' of the plug 63 impinges on but does not completely block or is immediately adjacent and below the beam of light from the light-emitting diode 58.

The formation of the plug 63 is due to a combination of the feed being greater than the take-up speed and the fact that egress of the yarn is restricted by the shoes 10 and 11, which is all well known. The restriction of the egress of the yarn takes place in normal operation by contact of the opposed faces 19 and 20 of the respective shoes 10 and 11 with the plug 63 at a portion of the plug 63 including part of the leading end 63' thereof as well as immediately subjacent protions of the plug. If is seen that the spacing between the opposed faces 15 and 16 of the respective rails 17 and 18 is slightly less than the spacing between the opposed faces 19 and 20 of the shoes 10 and 11 at the bottom of the shoes 10 and 11. Consequently, the width of the plug 63 is initially defined by the spacing between the faces 15 and 16. Thereafter, the plug 63 essentially holds this width and, hence, is out of contact with the faces 19 and 20 until the slight inward inclination imparted to the faces 19 and 20 by the action of the cylinder and piston assemblies 26, 27 on the shoes 10, 11 causes the faces 19 and 20 to contact the plug 63 at the aforementioned portions and slightly compress the plug 63, thereby restricting egress of the yarn. As is well known by hose skilled in the art, it is this restriction which exerts a back pressure against the forwarding of the yarn by the nip rolls 13 and 14, hence causing the yarn to buckle, form a plug and thereby crimp.

The pressure with which the pistons 30 and 31 act against the shoes 10 and 11 is adjusted so that the normal, steady-state operation of the apparatus is as illustrated in FIG. 3. It will be understood that, of course, some oscillation of the pistons and shoes will occur during normal operation.

Respective bores 64 and 65 are formed through the shoes 10 and 11 to permit the passage of light from the light-emitting diode 58 to the sensor 59. To assure that the leading end 63' of the plug 63 does not retreat downwards, where no means for sensing the position of the leading end of the plug is provided, the apparatus is operated at relative feed and withdrawal rates such that the leading end 63' of the plug 63 tends gradually to move upward. When the plug 63 has moved upward sufficiently so that the light is completely blocked, a relay in conventional circuitry is actuated to speed up the motor driving the take-up package 62 until the receiver again receives light from the light-emitting diode. It may be desirable to provide conventional means for effecting a slight time delay so that momentary blocking of the light is not sufficient to speed up the take-up whereby the apparatus does not respond to a very transient condition, response being unnecessary.

Though the aforementioned system is extremely durable, it is circumspect to make provision for a system failure as a consequence of which the plug continues to advance beyond the light path. In the illustrated embodiment, the back-up is provided by limit switches 60 and 61. In normal operation, as illustrated in FIG. 3, the respective actuating buttons 60' and 61' of the limit switches 60 and 61 just about abut against the respective outside faces 68 and 69 of the shoes 10 and 11. The buttons 60' and 61' are lightly spring-loaded and must be substantially depressed to actuate the switches. Turning to FIG. 1, we see that as a result of a failure in the primary sensing system or other malfunction, the head 63' of the plug 63 has advanced up to near the top of the shoes 10, 11. This has pushed the shoes 10, 11 outwardly so that the respective outer faces 68 and 69 thereof have substantially depressed the buttons 60' and 61' of the respective limit switches 60 and 61 thereby to actuate the limit switches. Actuation of either or both of the limit switches shuts down the driving of the feed rollers 13 and 14 as well as of the take-up package 62. Preferably, an audible and/or visible signal is also thereby actuated to alert the machine attendant.

Apparatus of the type to which the present invention relates is applicable to the crimping of yarns, threads, tows, and the like. These are referred to generically herein as "fibrous material."

While the invention has been described herein particularly with reference to a preferred embodiment, it is to be understood that the scope of the invention, as defined by the appended claims, is intended to include all modifications and variations thereof which would be obvious to one of ordinary skill in the art.

What I claim is:

1. Apparatus for compression crimping fibrous material comprising means defining a compression crimping zone in which a plug of compression crimped fibrous material is formed, means for feeding fibrous material into the compression crimping zone, means for withdrawing compression crimped fibrous material from the compression crimping zone, means for sensing the presence of the plug at a predetermined position in the zone and for the regulating at least one of the fibrous material feeding means and fibrous material withdrawing means in response to said sensing thereby to prevent said plug from moving substantially beyond said position, at least one movable member defining a lateral wall of the zone and being biased toward the fibrous material to restrict egress of the fibrous material from the zone and thereby exert a back pressure on the fibrous material, and means for deactuating the fibrous material feeding means and withdrawing means in response to displacement beyond a predetermined extent of the movable member in a direction opposite to the direction in which the movable member is biased, the deactuating means being arranged to operate if the plug advances substantially beyond said position whereby operation of the apparatus is interrupted.

2. Apparatus according to claim 1, comprising a second movable member, the second movable member being arranged opposite to the first movable member to define another lateral wall of the zone and the two movable members being biased toward each other, and second control means for deactuating the fibrous material feeding and withdrawing means in response to displacement beyond a predetermined extent of the second movable member in a direction opposite to the direction in which the second movable member is biased, the second deactuating means also being arranged to operate if the plug advances substantially beyond said predetermined position.

3. Apparatus according to claim 2, in which each of the first and second deactuating means comprises a respective limit switch.

4. Apparatus according to claim 1 in which the deactuating means comprises a limit switch.

5. Apparatus for compression crimping fibrous material comprising means defining a compression crimping zone in which a plug of compression crimped fibrous material is formed, means for feeding fibrous material into the compression crimping zone, means for withdrawing compression crimped fibrous material from the compression crimping zone, means for sensing the presence of the plug at a predetermined position in the zone and for regulating at least one of the fibrous material feeding means and fibrous material withdrawing means in response to said sensing thereby to prevent said plug from moving substantially beyond said position, the sensing means comprising a light-emitting diode and a sensor for the light emitted by the diode, said diode and said sensor being arranged on opposite sides of said zone with a path being defined for passage of the light from the diode to the sensor on a line which intersects the compression crimping zone at said predetermined position, said apparatus further comprising at least one movable member defining a lateral wall of the zone and being biased toward the fibrous material to restrict egress of the fibrous material from the zone and thereby exert a back pressure on the fibrous material, causing the fibrous material to buckle and thereby crimp in the zone, and means for deactuating the fibrous material feeding means and withdrawing means in response to displacement beyond a predetermined extent of the movable member in a direction opposite to the direction in which the movable member is biased, the deactuating means being arranged to operate if the plug advances substantially beyond said light path, whereby operation of the apparatus is interrupted in response to malfunctioning of control of the position of the plug in the crimping zone.

* * * * *

UNITED STATES PATENT AND TRADEMARK OFFICE

CERTIFICATE OF CORRECTION

PATENT NO. : 4,067,092

DATED : January 10, 1978

INVENTOR(S) : John S. Roberts

It is certified that error appears in the above-identified patent and that said Letters Patent are hereby corrected as shown below:

In the Title Page insert:

[73] Assignee: Kling-Tecs, Inc.
Columbia, Maryland

Signed and Sealed this

*Sixteenth* Day of *May 1978*

[SEAL]

*Attest:*

RUTH C. MASON
*Attesting Officer*

LUTRELLE F. PARKER
*Acting Commissioner of Patents and Trademarks*